US009495681B2

(12) United States Patent
Holsman et al.

(10) Patent No.: US 9,495,681 B2
(45) Date of Patent: Nov. 15, 2016

(54) SYSTEMS AND METHODS FOR WEB PAGE OPTIMIZATION

(75) Inventors: Ian Holsman, Richmond (AU); Sultana Darya, Aldie, VA (US)

(73) Assignee: AOL Inc., Dulles, VA (US)

( * ) Notice: Subject to any disclaimer, the term of this patent is extended or adjusted under 35 U.S.C. 154(b) by 789 days.

(21) Appl. No.: 13/215,818

(22) Filed: Aug. 23, 2011

(65) Prior Publication Data

US 2013/0054348 A1 Feb. 28, 2013

(51) Int. Cl.
*G06Q 30/00* (2012.01)

(52) U.S. Cl.
CPC ..... *G06Q 30/00* (2013.01)

(58) Field of Classification Search
CPC ..... G06Q 30/0244
USPC ..... 705/14
See application file for complete search history.

(56) References Cited

U.S. PATENT DOCUMENTS 6,662,215 B1 * 12/2003 Moskowitz ..... G06F 17/30867 705/14.34
8,321,359 B2 * 11/2012 Buchs et al. ..... 706/19
8,725,795 B1 * 5/2014 Amacker ..... G06F 17/30702 709/203
2006/0036400 A1 * 2/2006 Kasriel et al. ..... 702/182
2007/0088609 A1 * 4/2007 Reller et al. ..... 705/14
2009/0089141 A1 * 4/2009 Lara et al. ..... 705/10
2009/0282343 A1 * 11/2009 Catlin et al. ..... 715/738
2010/0017704 A1 * 1/2010 Jaffe et al. ..... 715/243
2011/0276411 A1 * 11/2011 McElfresh et al. ..... 705/14.66
2012/0303443 A1 * 11/2012 Zeine et al. ..... 705/14.41
2016/0063574 A1 * 3/2016 You ..... G06Q 30/0275 705/14.71

* cited by examiner

*Primary Examiner* — Matthew L Hamilton
(74) *Attorney, Agent, or Firm* — Finnegan, Henderson, Farabow, Garrett & Dunner, L.L.P.

(57) ABSTRACT

Systems and methods are provided for web page optimization. In accordance with one implementation, a system for web page optimization is provided, wherein the system comprises a computing device configured to provide at least one of user data, content categories, and page performance metrics, and receive, from the module server, a bid to include at least one proposed module on a page, the bid including an impact score of the at least one proposed module based on the page performance metrics. The system also includes a feedback component configured to provide performance feedback indicative of how the page performed based in part on the page performance metrics, and a page assembler coupled configured to select for display on the page a module combination comprising the at least one proposed module, wherein the module combination is selected based in part on the impact score and the performance feedback.

37 Claims, 5 Drawing Sheets

200

400

SYSTEMS AND METHODS FOR WEB PAGE OPTIMIZATION

TECHNICAL FIELD

The present disclosure generally relates to techniques for optimizing web pages displayed to users. In particular, and without limitation, the present disclosure relates to computerized systems and methods for optimizing a web page by selecting components to be displayed on the web page. The components may be selected so as to optimize one or more metrics for a web site owner.

BACKGROUND

Web site owners often evaluate the performance of their site based on metrics. For example, site owners often rely on user traffic as a proxy or indicator of how much revenue a particular site or web page on a site generates. Increased traffic, for some sites, may in many cases, increase revenue from advertisements. To maximize revenue from ads, web site owners populate a page with ads and/or other components related to specific content or a particular user demographic.

In selecting ads to increase revenue, web site owners often consider how to decide which ads to select for display on a particular page. To decide which ads to select, a web site owner, in some cases, may delegate this decision to a page designer. For example, a page designer may decide which ads to display based on heuristics or simply a "gut feeling." In other cases, a site owner may delegate this decision to one or a combination of service providers. These service providers may include, among others, ad networks, ad exchanges, or aggregation services.

Delegating the decision of which ads to select to either a page designer or a service provider, in many cases, may not maximize the web site owner's revenue or other business objectives. Traditional approaches often focus on revenue directly generated by a particular ad, rather than on how an ad or combination of ads affects revenue generated by a particular page. Furthermore, revenue generation alone may not be a sufficient metric to assess whether a site owner is on track to achieve their business objectives.

It is therefore desirable to provide improved systems and methods that optimize web pages of a web site to enable a web site owner to better achieve their objectives. Moreover, there is a need for improved systems and methods for web page optimization by selecting a component or combination of components for a web page based on one or more metrics. Still further, there is a need for techniques that can dynamically decide which ads or other components should be placed on a given page based on a combination of metrics.

SUMMARY

Consistent with the present disclosure, embodiments are provided for optimizing web pages displayed to users. In accordance with certain embodiments, computerized systems and methods are provided for optimizing a web page by selecting one or more components to be displayed on the web page. As disclosed herein, the components may be selected so as to optimize one or more metrics for a web site owner.

In accordance with additional embodiments, systems and methods are provided that can dynamically decide which ads or other components should be placed on a web page based on a combination of metrics. The metrics may be relevant to one or more objectives of a web site owner. In certain embodiments, the objectives comprise business objectives, such as revenue, user engagement, or network recirculation.

Embodiments of the present disclosure also comprise systems and methods for web page optimization based on the selection of modules. Consistent with the present disclosure, a module may comprise a unique component of a web page. In certain embodiments, components are distinct from the main content of a web page. By way of example, components may include an advertisement, a list of most popular articles, a list of related photos and videos, and links to third party sites. Other examples of components are disclosed herein and will be apparent to persons of ordinary skill in the art.

In accordance with still further embodiments of the present disclosure, systems and methods for web page optimization are provided that include or utilize a module server, a feedback component, and a page assembler. Consistent with certain embodiments, the module server provides a bid to include at least one proposed module on a web page. Further, the feedback component may be coupled to the module server and provide performance feedback indicative of how the page performed based on page performance metrics. In addition, as disclosed herein, the page assembler may be adapted to select for display on the page a module combination including the at least one proposed module. In certain embodiments, the selection performed by the page assembler is based in part on an impact score and the page performance feedback associated with the at least one proposed module. Also, in certain embodiments, the impact score may comprise a value reflective of how the at least one proposed module affects a predetermined metric.

Consistent with the present disclosure, embodiments are provided that may be implemented in any suitable combination of hardware, software, and/or firmware. Examples of such implementations are provided in this disclosure. Various system environments may also be used for implementing the disclosed systems and methods of the present disclosure. For example, the disclosed embodiments may be implemented as part of page designer system, a content management system, or a system environment of an ad network, ad exchange, or aggregation service.

Consistent with some embodiments of the present disclosure, a system for displaying electronic content may include a computing device configured to provide, to a module server, at least one of user data, content categories, and page performance metrics. The computing device may be further configured to receive, from the module server, a bid to include at least one proposed module on a page. The bid may include, among other data, an impact score of the at least one proposed module based on the page performance metrics. The system may also include a feedback component coupled to the computing device and the module server, and configured to provide performance feedback indicative of how the page performed based in part on the page performance metrics. Furthermore, the system may include a page assembler coupled to the feedback component and the computing device, and configured to select for display on the page a module combination comprising the at least one proposed module. In some embodiments, the module combination may be selected based in part on the impact score and the performance feedback.

Consistent with some embodiments of the present disclosure, a method of displaying electronic content is provided. The method may include sending to the module server at least one of user data, content categories, and page performance metrics. The method may also include receiving, from a module server, a bid to include at least one proposed module for display on a page, the bid including an impact score of the at least one proposed module based on the page performance metrics. The method may also include receiving, from a feedback component, performance feedback indicative of how the page performed based in part on the page performance metrics. Furthermore, the method may include selecting for display on the page a module combination comprising the at least one proposed module. In some embodiments, the module combination may be selected based in part on the impact score and the performance feedback.

Consistent with still additional embodiments of the present disclosure, a computer readable medium comprising instructions that when executed by a processor, cause the processor to perform the method of displaying electronic content. The method may include sending to the module server at least one of user data, content categories, and page performance metrics. The method may also include receiving, from a module server, a bid to include at least one proposed module for display on a page, the bid including an impact score of the at least one proposed module based on the page performance metrics. The method may also include receiving, from a feedback component, performance feedback indicative of how the page performed based in part on the page performance metrics. Furthermore, the method may include selecting for display on the page a module combination comprising the at least one proposed module. In some embodiments, the module combination may be selected based in part on the impact score and the performance feedback.

It is to be understood that both the foregoing general description and the following detailed description are exemplary and explanatory only, and are not restrictive of the disclosed embodiments as claimed. Further, the accompanying drawings, which are incorporated in and constitute a part of this specification, illustrate embodiments of the present disclosure and together with the description, serve to explain principles of the present disclosure as set forth in the accompanying claims. Additional features and advantages of the disclosure will be set forth in part in the description which follows.

BRIEF DESCRIPTION OF THE DRAWINGS

The accompanying drawings, which are incorporated in and constitute a part of this specification, illustrate embodiments disclosed herein, together with the description, serve to explain the principles of the disclosed embodiments.

DETAILED DESCRIPTION

Reference will now be made in detail to disclosed embodiments illustrated in the accompanying drawings. Wherever possible, the same reference numbers will be used throughout the drawings to refer to the same or like portions. It should be noted that the drawings provide exemplary illustrations and are not to precise scale.

In the following description, the use of the singular includes the plural unless specifically stated otherwise. In this description, the use of "or" means "and/or" unless stated otherwise. Furthermore, the use of the term "including," as well as other forms such as "includes" and "included," is not limiting. In addition, terms such as "element" or "component" encompass both elements and components comprising one unit, and elements and components that comprise more than one subunit, unless specifically stated otherwise.

Additionally, the terms "coupled" and "connected," along with their derivatives, may be used. It should be understood that these terms are not intended as synonyms for each other. Rather, in particular embodiments, "connected" and/or "coupled" may be used to indicate that two or more elements are in direct physical or electronic contact with each other. However, "coupled" may also mean that two or more elements are not in direct contact with each other, but yet still cooperate, communicate, and/or interact with each other.

Figure 1:
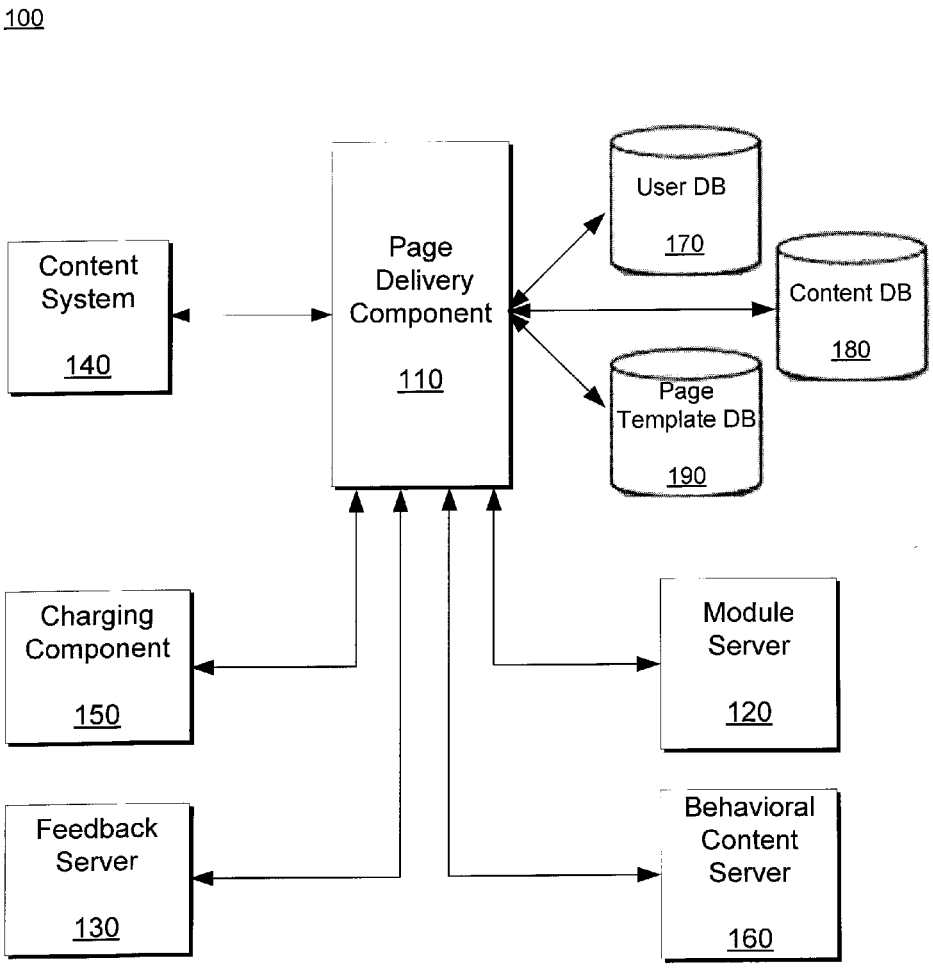
FIG. 1 illustrates a block diagram of an exemplary system for web page optimization, consistent with the disclosed embodiments.

FIG. 1 illustrates a block diagram of an exemplary system 100 for web page optimization, consistent with disclosed embodiments. By way of example, and as illustrated in FIG. 1, the exemplary system 100 may include a page delivery component 110, a feedback component 130, and a charging component 150. As further disclosed herein, page delivery component 100 may decide which modules should appear on a particular page. Page delivery component 110 may be coupled to feedback component 130 and charging component 150. In some embodiments, page delivery component 110 may be coupled to feedback component 130 and charging component 150 using one or more wired or wireless communication channels. For example, such a communication channel may use a standard's based interface protocol, such as Ethernet, Peripheral Component Interface (PCI) Express, or other interface methods with suitable signaling, protocol, and bandwidth characteristics.

In accordance with certain embodiments, page delivery component 110, feedback component 130, and charging component 150 may each be implemented with a computing device, such as a server or computer. Such a server or other computing device may include any suitable combination of hardware, software, and/or firmware. For example, the computing device may include at least one processor and a set of programmed instructions adapted to perform the methods and techniques disclosed herein when executed by the processor. Furthermore, in certain embodiments, components 110, 130, and 150 may be located at a common facility or location. Additionally, components 110, 130, and 150 may be implemented as part of a server system or server farm, comprising a load balancer and one or more servers. In accordance with still further embodiments, components 110, 130, and 150 may be implemented as part of a distributed architecture, with each component including a computing device that is in electronic communication with a computing device of the other components.

Although the exemplary embodiment of FIG. 1 illustrates a computing environment with a certain number of components or devices (including with respect to components 110, 130, and 150), persons of ordinary skill in the art will recognize that the diagram is merely exemplary and the computing environment may include any number of components or devices. Moreover, additional computing devices may be provided, such as mobile or stationary client-side devices, without departing from the spirit or scope of the disclosed embodiments.

In some embodiments, page delivery component 110 may be a computing system configured to dynamically publish web site content based on predetermined metrics established by the site owner. Page delivery component 110 may include a computing device, such as a server, or a combination of servers located in the same or in geographically distinct locations. For example, page delivery component 110 may include one or more of the following components: at least one processor configured to execute instructions to perform various module display determination system instructions and methods, memory configured to store and provide information and a set of programmed instructions, I/O devices, and interfaces.

In accordance with some embodiments, memory may be a computer readable memory, such as a random access memory (RAM), a read-only memory (ROM), a hard disk, an optical disk, a magnetic medium, a flash memory, other permanent, fixed, volatile memory, non-volatile memory, or any other tangible mechanism capable of providing instructions to a processor or similar component. For example, a memory may store instructions and data to perform module display determination functions in accordance with information received from module server 120, content system 140, feedback component 130, and exemplary databases 170, 180, and 190. Memory may be distributed. That is, portions of the memory may be removable or non-removable, or located in geographically distinct locations.

As used herein, the term "processor" may include an electric circuit that executes one or more instructions. For example, such a processor may include one or more integrated circuits, microchips, microcontrollers, microprocessors, embedded processor, all or part of a central processing unit (CPU), digital signal processors (DSP), FPGA or other circuit suitable for executing instructions or performing logic operations. A processor may be a special purpose processor in that it may be configured and programmed to operate as a module display determination system processor programmed to exchange commands and data with content system 140, user database 170, content database 180, page template database 190, charging component 150, module server 120, feedback component 130, and behavioral content server 160.

To gather data to assemble a particular page, page delivery component 110 may be coupled to content system 140, module server 120, and behavioral content server 160. By way of example, page delivery component 110 may be coupled to content system 140, module server 120, and behavioral content server 160 using one or more wired or wireless communication channels as previously described.

In accordance with some embodiments, content system 140 includes a computing system configured provide electronic content for one or more web sites. For example, content system 140 may be a content management system configured to store and provide page content and related data. Content system 140 may include software tools and one or more servers and/or databases for editing, caching, storing content. Content and other data gathered from content system 140 may be stored in content database 160 for further processing or later access.

In accordance with some embodiments, module server 120 may be an aggregation system, broker agent, ad network, or third party content provider configured to provide ads or other modules to site owners. Consistent with the present disclosure, a module is a unique component of a page, such as an advertisement, or areas such as, "most popular article," "customer also bought," "related photos and videos." Components for a web page may also comprise lists or links, including lists of related content and links to third party sites. Furthermore, components for a web page may comprise any combination of content, including text, audio, video, images, and graphics.

Figure 3:
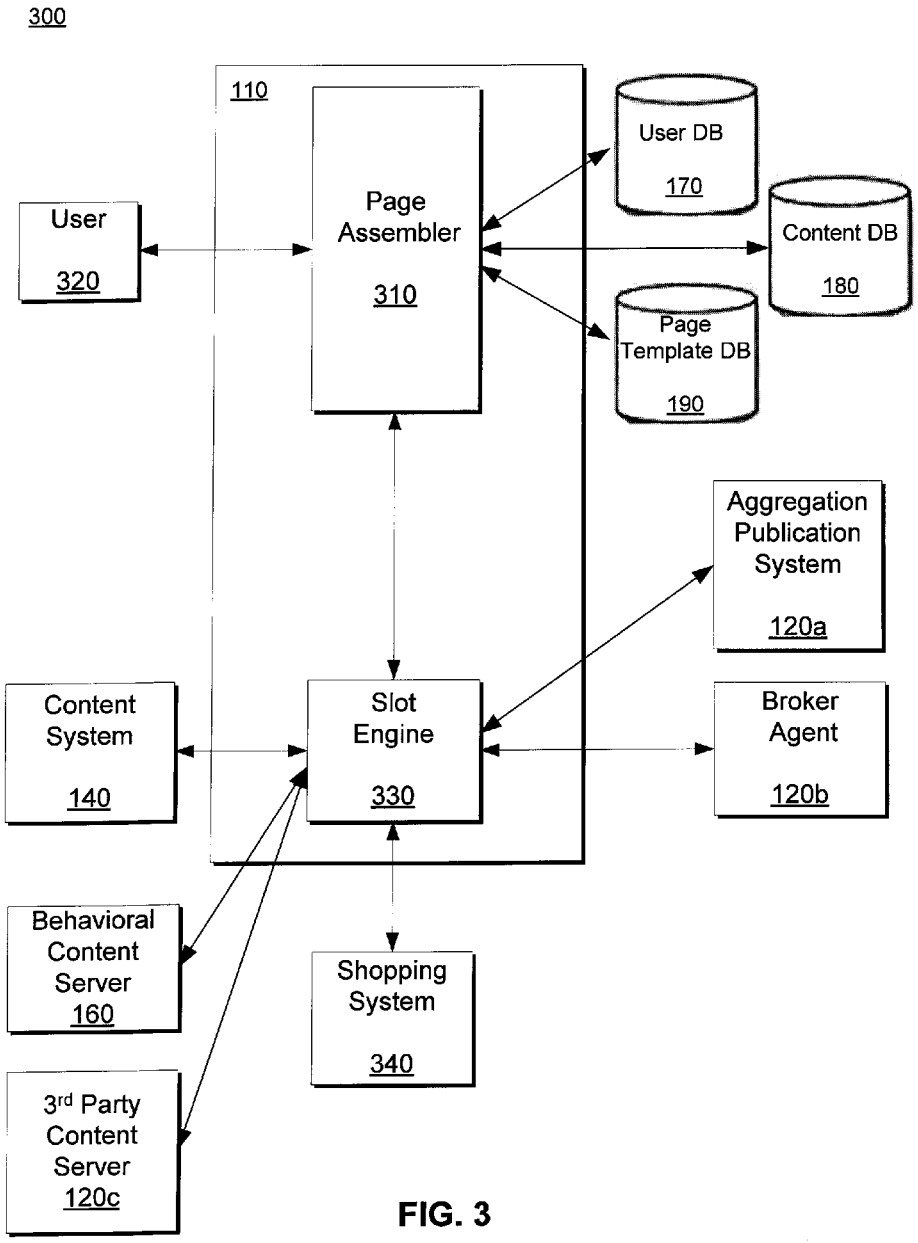
FIG. 3 illustrates a block diagram of another exemplary system for web page optimization, consistent with the disclosed embodiments.

Although shown as a single provider in the example of FIG. 1, in other exemplary embodiments module server 120 may include one or more module servers (such as servers 120*a*, 120*b*, and 120*c*), as illustrated in the example of FIG. 3. Module server 120 may be configured to receive requests or bids from page delivery component 110. Requests for bids may include at least one of user data, a list of content categories, business objective data, and predetermined page performance metrics. User data may include, among other things, demographic, behavioral, geographic, and temporal data. User data may also include biographical information, geographic information, and behavioral information, such as time of day, categories or types of pages viewed, min/max/mean click-through rate (CTR) on content, min/max/mean CTR on ads, revenue per thousand impression (RPM), and other metrics known to those skilled in the art. Alternatively or additionally, user data may also include system information or other data associated with a particular user, such as, Internet Protocol (IP) address, Media Access Control (MAC) address, a cookie, and user identification mapping.

In accordance with some embodiments, content categories may be based on a central categorization taxonomy shared by module service providers. In other embodiments, content categories may be determined by the site owner and distributed to module service providers through their respective module servers. In some cases, page delivery component 110 may send content categories to module server 120 within the request for a bid. In other cases, content categories may be sent to module server 120 using a separate communication.

In accordance with some embodiments, a site owner may choose performance metrics that allow the site owner to maximize or optimize the business objectives of a particular page. Some business objectives may focus on maximizing revenue. Other objectives may focus on, without limitation, user engagement, network recirculation, or other objectives. In some cases, a site owner may focus on a particular combination of metrics to achieve a particular objective. In general, the performance of each of the predetermined metrics may be measured in view of the page performance as a whole. Exemplary performance metrics, may include, without limitation, revenue, user engagement, and network recirculation, or any other metric suitable to evaluate a particular objective of a web site owner, including a business objective.

Revenue may include direct revenue and indirect revenue generated from a user action applied to module or a combination of modules displayed on a page. Direct revenue may include, for example, revenue generated when a user clicks on an ad or other module displayed on a page. Indirect revenue, in contrast, may include revenue generated from or related to the presence of a particular module on a page. For example, placing a particular module or combination of modules, such as a photo module, on a page may cause a user to click on more ads on the page. In this case, the photo module generates revenue, although not necessarily direct revenue. Revenue may also be generated by additional user activity on the page. In another example, entertainment news present on a site owner's portal page may cause the user to return more frequently, increasing visits/month metric and return visit metrics, as compared to when there is no entertainment news on the portal page, even though the user does not actually click on any stories in that module. In another example, another module, such as a module referring to the author's resume, or 'weird news' might show decreased overall page performance, even though the module's CTR is higher than other modules. In some cases, the decreased overall performance may be due to a user clicking on that module, which has poor revenue/overall engagement, instead of something that yields higher performance for the site owner. In another example, revenue on page could come from the long-term effect of having users visit a site more often. For example, while a user clicking on an advertisement might bring in a short-term gain, the user might never return to the site or page. In contrast, a user who has not been shown that advertisement on their initial visit(s) might change their behavior and bookmark the page or site, and visit the page or site more often, resulting in the user clicking more ads in their lifetime.

User engagement may reflect how much longer a user spends on a particular page when a module or a particular combination of modules is present on a page. User engagement may also reflect whether a user returns to a particular page more often when a module or a particular combination of modules is present on a page. Network recirculation may reflect the likelihood a user will visit another page on a site or network of sites provided by a particular site owner.

In accordance with some embodiments, module server 120 may be configured to send page delivery component 110 a bid that includes, among other data, proposed modules it can offer in response to the bid request. Module server 120 may also provide, for example, content categories associated with the proposed modules offered in response to the bid request, and an impact score. Consistent with certain embodiments, the impact score may represent the impact or affect that each module or combination of modules will have on each of the respective performance metrics. In some embodiments, module server 120 may determine how to calculate the impact of each proposed module relative to a page performance metric. Moreover, in certain embodiments, module server 120 may adjust this calculation based on historical performance data of pages module server 120 placed a bid on in the past.

In accordance with some embodiments, feedback component 130 may include any suitable combination of hardware, software, and/or firmware to provide feedback information concerning the performance of a particular page hosted by a web site owner. For example, feedback component 130 may be configured to gather and provide performance feedback of a particular page to page delivery component 100 and/or module server 120. Performance feedback may include historical performance information related to how a page, a module, or a combination of modules performed in view of predetermined performance metrics provided by the site owner. Feedback component 130 may be configured to provide performance feedback to module server 120. In this case, performance feedback may include metrics on how the page performed with a module provided by module server 120. Alternatively or additionally, performance feedback provided to module server 120 may include how the page performed in aggregate. For example, in some embodiments, feedback component 130 may be configured to measure how various combinations of modules perform, say tracking CTR, ad-revenue, or user-engagement for every combination over time. Using these base metrics and/or a combination of user-supplied weightings on how important each of those metrics are to the site, feedback component 130 may be configured to determine which combinations of modules should be displayed. For example, a site might prefer to see modules with more user-engagement, while another site might be focusing on ad-revenue for a given time period. In this example, feedback component 130 may operated to use a reinforcement learning approach to determine which module combination to display. In other embodiments, feedback component 130 may be configured to keep track of additional metrics, including, but not limited to user demographics and time of day, to determine the best module combination to display at a given instance. For example, for users aged 25-35 at 11 am, modules A, B, C should be shown on entertainment, while users aged 55+ at 11 am should be shown modules B,C,D on entertainment, and users aged 25-35 at 3 pm should be shown D,B,E on entertainment. In other embodiments, this approach be applied to behavioral segments as well, such as user likes pop-music, or NHL sports.

Feedback component 130 may also be configured to provide performance feedback to page delivery module 110. Performance feedback received by page delivery module 110 may include historical performance data of a page, module, or a combination of modules.

Performance feedback provided by feedback component 130 may range in detail. For example, performance feedback may include the number clicks received by a module, and variation in how long a user spends on a page when a received by a module, and variation in how long a user spends on a page when a particular module or combination of modules is located on a page. Performance feedback may also include, for example, if a user clicked on ad/link-out and the average click-through rate of the page. Feedback component 130 may be configured to periodically update module server 120. Periodic updates may occur at regular intervals, in response to a request from module server 120, or at any other interval.

In accordance with some embodiments, charging component 150 may include any suitable combination of hardware, software, and/or firmware to charge for placement of modules on a page. For example, in some embodiments, charging component 150 may charge a module owner based on how a proposed module performs on a page in view of the page as a whole and/or certain predetermined performance metrics. In operation, the site owner may attribute a particular value or weighting to each performance metric using page delivery component 110.

In accordance with some embodiments, behavioral content server 160 may be configured to provide data identifying user behavior to page delivery component 110. For example, behavioral content server 160 may be a server or computing device that stores and provides user behavior data. Behavioral data can include, without limitation, categories of the pages previously visited by a user during a specific period of time. In another example, behavioral content server 160 might also use activity from a social networking application to build a behavioral profile based on a users 'likes,' or re-tweets, or who a users follows. For example a person who follows a particular entertainer on a particular social networking application can be assumed to like the particular entertainer and the type of entertainment, such as a music genre, associated with that entertainer, even if they haven't visited those pages on the site owner's site yet.

In accordance with certain embodiments, data received by page delivery component 110 may be stored in one or more databases. By way of example, and as illustrated on FIG. 1, exemplary databases may include user database 170, content database 180, and page template database 190. The exemplary databases may be a structured collection of tables, lists, or other data. As such, the structure may be organized as a relational database or an object-oriented database. In other embodiments, exemplary databases may be a hardware system comprising tangible computer readable storage media and input and/or output devices configured to receive and provide access to tables, lists, or other data structures. Further, configured as a hardware system, exemplary databases may include one or more processors and/or displays.

In operation, data received by page delivery component 110 from content system 140 may be stored in and retrieved from content database 160. User database 170 may be configured to store and provide user data to delivery component 110. User information, for example, may include biographical information, geographic information, and behavioral information, such as time of day, categories or types of pages viewed, min/max/mean CTR on content, min/max/mean CTR on ads, RPM, and other metrics known to those skilled in the art. Alternatively or additionally, user database 170 may be configured to store and provide system information or other data associated with a particular user, such as, Internet Protocol (IP) address, Media Access Control (MAC) address, a cookie, and user identification mapping. Page template database 190 may be configured to store and provide predetermined page templates later populated with content and/or one or a combination of modules. By way of example, and as illustrated in FIG. 1, page delivery component 110 may be coupled to communicate with the exemplary databases using one or more wired or wireless communication channels as previously described.

Figure 2:
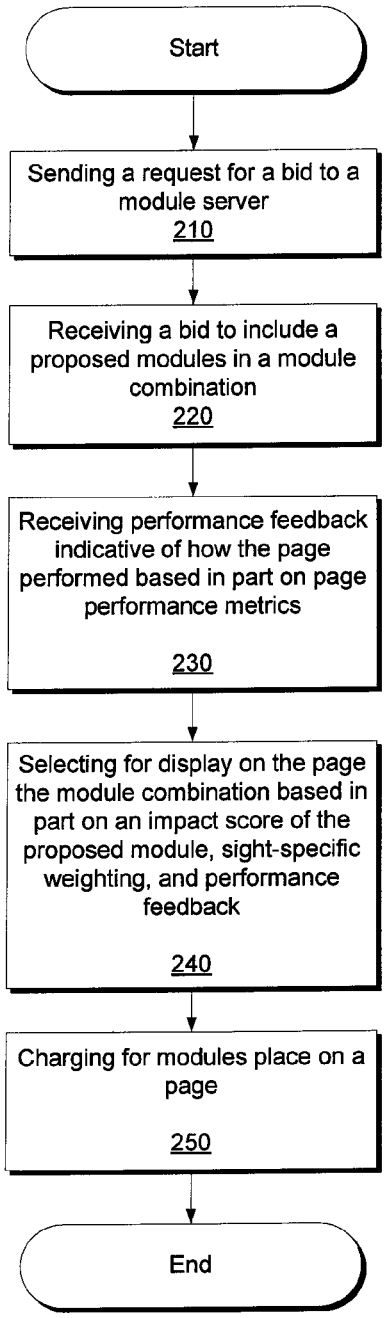
FIG. 2 illustrates a flow diagram of an exemplary method of web page optimization, consistent with the disclosed embodiments.

FIG. 2 illustrates a flow diagram of another exemplary method 200 for web page optimization, consistent with embodiments of the present disclosure. The method 200 of FIG. 2 will be described with reference to common or similar module services. It will be appreciated, however, that the exemplary method 200 can be adapted for any type of electronic content or combination of module services, including videos, audio files, images, articles, blogs, and/or other content accessible over the Internet.

By way of example, exemplary method 200 may enable a web site owner to send requests to a module provider to bid on module slots on a web page. Because the request includes information indicating how the site will evaluate and value a proposed module, a module provider's bid can provide the web site owner with an indication of how a proposed module will impact the site owner's business objectives for each page, as well as the categories of content the module provider can service. Although FIG. 2. illustrates the steps of method 200 with a single module server and/or provider (e.g., module server 120) and a single bid, embodiments based on method 200 may be implemented with a plurality of module servers and/or providers submitting a plurality of bids.

As shown in FIG. 2, in step 210, a request for a bid is sent to a module server. In accordance with some embodiments, the request for a bid may include user data, content categories, page performance metrics, and/or business objective data. For example, page delivery component 110 may send a business objective along with a particular bid request, indicating that for this bid request the web site owner values a particular metric more than other metrics. In accordance with some embodiments, a bid request may be initiated or called on the server-side. For example, page delivery component 110 may initiate a bid session. In other embodiments, page delivery component 110 may be called from the client-side, such as by a user, during page delivery or rendering. For example, client-side code may be embedded in a browser or included in a separate file accessible by a user through a computing device and configured to call page delivery component 110 to initiate a bid. Client-side code may include, without limitation, JavaScript source code, VBScript source code, or code programmed in any other scripting language suitable to exchange data with a server and/or respond to user input without communication from the server. In accordance with some embodiments, a bid request may be provided to each module server. In other embodiments, a bid request may be provided to select module servers in response to a query of feedback server 130. For example, page delivery component 110 may query feedback server 130 for a list of modules having proposed impact values that met or exceeded their actual performance with respect to page performance metrics. Page delivery component 110 may also query feedback server 130 for modules that previously indicated being able to provide particular content categories.

In step 220, in response to sending a request for bid, one or more bids are received. Each received bid may be for a proposed module or modules in a module combination to be displayed on a page. For example, module server 120 sends a bid to page delivery component 110 indicating a list of modules, content categories, and an impact score. The impact score may represent the impact or affect that each module will have on each of the respective performance metrics, as disclosed herein. In some embodiments, the impact score may be a unitless value, such as an integer ranging from 1 to 5 or any range suitable to determine the relative performance of a module in view of predetermined performance metrics.

In accordance with some embodiments, module server 120 may also provide a price or other monetary value or criteria associated with a proposed module. For example, in response to a bid request, module server 120 may notify the page assembler 310, through or using slot engine 330, that the module should have a 5% impact on CTR, provide content in a food category, and cost $3.00 to put on a page. In some embodiments, module server 120 may represent an impact score as a numerical value within a range of values according to the relative impact a proposed module is predicted to have on a particular metric. For example, module server 120 may assign impact scores to a module labeled "customers also bought" as follows: Revenue=1; User engagement=2; Network recirculation=5. In this example, an impact score may range from 1 to of 5, 1 being the lowest impact and 5 being the highest impact. That is, by ranking the metric network recirculation a 5, module server 120 communicates to page delivery component 110 that the proposed module has a larger impact on network recirculation than metrics revenue or user engagement. Though the following example represents the respective impact scores as unitless values, the impact scores may also have units. Further, other number types or range of values may be used to represent an impact.

To improve the likelihood that a particular bid will be accepted by page delivery component 110, module server 120 may adjust the weighting or process used to calculate impact score based on historical performance data provided by feedback server 130. Historical performance data may include metrics on how the page performs with a proposed module, and how the page performs in aggregate so that scoring algorithms may be appropriately adjusted. For example, using historical performance data module server 120 may adjust the weighting applied to the module labeled "customers also bought" as follows: Revenue=1*(RHP);

User Engagement=2*(UEHP); Network Recirculation=5*(NRHP). Respective historical performance weighting factors revenue historical performance (RHP), user engagement historical performance (UEHP), and network recirculation historical performance (NRNP) may be scale factors value suitable to represent the relative performance of a particular metric and recognized as such by page delivery component 110.

In accordance with some embodiments, module server 120 may further adjust the impact score based in part on information gathered using, but not limited to, a beacon or cookie generated by the module server. In operation, module server 120 receives information about the site's objectives to deliver better results. If, for example, a particular module is more interested in user-engagement today, that module can provide that hint to module server 120 so that module server 120 can choose to answer with modules that it thinks better contribute to user-engagement—as opposed to module server 120 selecting higher-RPM revenue alternatives. In some cases, past performance information may be used to stop module servers from exploiting or otherwise taking unfair advantage of the bidding system. For example, even if module server 120 responds indicating that the module it returns is a '5' in a certain category, historical performance data may be used to better normalize it's response with other 3rd party module servers. For example, a deal-site might think it's a '5', but compared to other module servers it's '5' appears to be closer to a '3' from other module-servers.

In some embodiments, a site owner may provide one or more http or web cookies to module-server 120 to enable the site owner to map user-data with the site owner's internal user-data. For example, a user on an auction site might have recently bid on some electronics that another site has no knowledge of. By mapping the user-data with site owner's own user-data, the module server associated with the auction site can provide customized electronics content, or possibly show current auctions the user is participating in, instead of some generic content. Thus, making the user more valuable to the module-server associated with the auction site, and letting site owner of the auction site submit a higher bid than it would have if it had less knowledge about the user. The embodiments disclosed herein are not intended to be limited to these examples, but may also include other methods of retargeting known to those of ordinary skill in the art.

When a bid is accepted, module server 120 may receive a notification that the proposed bid is accepted and an indication of what impact the proposed module had on the page. For example, page delivery component 110 may notify module server 120 that its proposed bid was accepted and clicked on "x" number of times. In other cases, the impact may be represented as variation in how long a user spent on a page when a particular module or combination of modules was located on a page, or if a user clicked on ad/link-out and the average click-through rate of the page.

In step 230, performance feedback indicative of how the page performed may be gathered and provided by a feedback component. For example, feedback component 130 may collect data indicating the performance of a page in view of the page performance metrics established by the site owner. In some embodiments, performance feedback may indicate how a particular page performed with a proposed module or combination of proposed modules in accordance with the page performance metrics. Performance feedback may also include how a particular page performed in aggregate, regardless of whether or not a particular proposed module was present on the page. Additionally, or alternatively, performance feedback provided by feedback component 130 may include, for example, the number clicks received by a module, variation in how long a user spends on a page when a particular module or combination of modules is located on a page, and data indicating if a user clicked on ad/link-out and the average click-through rate of the page.

In accordance with some embodiments, feedback component 130 may act as an equalizer by providing feedback performance to page delivery component 110, which provides an indication of the impact value associated with the respective performance metrics anticipated by module server 120 for a proposed module or combination of modules. In addition, feedback component 130 periodically may update module server 120 at regular intervals, in response to a request from module server 120, or at any other interval or basis.

Once received, in step 240, page delivery component 110 processes and ranks bids to select a module combination for display in a manner that maximizes the business objectives of the site owner with respect to a particular page. For example, page delivery component 110 may apply web site or page specific weightings, either specified manually by the site owner or calculated by page delivery component 110 based on what is required to achieve a business objective or target in view of the established page performance metrics. In some embodiments, to rank bids, page delivery component 110 may call feedback server 130 to get historical information related to the historical performance of each proposed module on a particular site. Additionally, in accordance with some embodiments, historical performance may be used to rank modules according to the following:

Rank=(revenue impact score*site-specific weighting*historical performance)+(user engagement impact score*site-specific weighting*historical performance)+(network recirculation impact score*site-specific weighting*historical performance).

In some embodiments, variables Rank, site-specific weightings, and historical performance may be unitless values. Variable site-specific weightings may represent a scale factor relative to the importance page delivery component 110 may assign to a particular module. As such, site specific weighting may be, without limitation, a unitless numerical value, a function, or an algorithm. As previously described, an impact score may be a unitless numerical value within a range of values representing the relative impact of a particular module with respect to a particular metric. In other embodiments, the impact scores may also have units. Further, other number types or range of values may be used to represent an impact score. Historical performance data, as previously described, may include metrics on how the page performs with a proposed module, and how the page performs in aggregate so that scoring algorithms may be appropriately adjusted. For example, using historical performance data module server 120 may adjust the weighting applied to the module labeled "customers also bought" as follows: Revenue=1*(RHP); User Engagement=2*(UEHP); Network Recirculation=5*(NRHP). Respective historical performance weighting factors revenue historical performance (RHP), user engagement historical performance (UEHP), and network recirculation historical performance (NRNP) may be scale factors value suitable to represent the relative performance of a particular metric and recognized as such by page delivery component 110. An exemplary rank calculation for the module "customer also bought" where page delivery component 110 seeks to maximize revenue may be calculated by page delivery component 110 by applying a site specific weighting factor of 5, 1, and 1, respectively for metrics revenue, user engagement, and network recirculation, respective impact scores of revenue, user engagement, and network recirculation are 1, 2, and 5, and the respective historical performance weighting factors are 5, 7, and 2, are as follows: Rank=(1*5*5)+(2*7*1)+(5*2*1)=49.

In cases where multiple modules return bids, page delivery component 110 identifies those modules. Page delivery component 110 may then apply a multiplier to the ranking algorithm due to the multiplicative effect resulting from placing both modules on a page. For example, if aggregation publication system 120*a* and broker agent 120*b*, as shown in FIG. 3, submit bids indicating they can serve finance-related modules, having both modules on a page will likely have a greater effect compared to having just one of them. In such case, the above exemplary ranking algorithm may be modified as follows: $\text{Rank}=(1*5*5)*CM_{revenue}+(2*7*1)CM_{user\ engagement}+(5*2*1)CM_{network\ recirculation}$. Multipliers $CM_{revenue}$, $CM_{user\ engagement}$, and $CM_{network\ recirculation}$ may be a unitless numerical value, such as an integer. In other embodiments, multipliers may be a function or algorithm suitable to reflect the increased weight given to duplicative modules proposed to be placed on a web page. Once ranked, page delivery component 110 may select the top "x" number of modules and returns the selected modules to the content management system that called them.

In step 250, a site owner charges module owners for placement of their respective modules on a page. For example, charging component 150 may charge a module owner providing module server 120 based on how a proposed module performs on a page in view of the page as a whole in view of the predetermined performance metrics. Charging may occur at the time of the auction or bid submission, by assigning each performance metric a particular value. In accordance with other embodiments, charging may be implemented consistent with the terms of a contract or predetermined billing procedure. For example, a module provider may contract with the site owner based on a proposed number of click-throughs on a site, the demographic/behavioral targeting segment of those clicks, or other suitable metrics.

FIG. 3 illustrates a block diagram of another exemplary system 300 for web page optimization, consistent with disclosed embodiments. By way of example, and as illustrated in FIG. 3, page delivery component 110 may include, without limitation, page assembler 310 and slot engine 330. Page assembler 310 may be any suitable combination of hardware, software, and/or firmware to perform various functions and methods. In some embodiments, page assembler 310 may include one or more processors configured to execute code to publish a web page in accordance with the methods and techniques described herein.

To select a module or a combination of modules to display on a page, page assembler 310 may be configured to call slot engine 330 to send bids to one or more of module server(s) 120, such as aggregation publication system 120*a*, broker agent 120*b*, and third party content server 120*c*. Once received, page assembler 310 processes and ranks the bids to select a proposed module or combination for display in a manner that maximizes the objectives of the site owner with respect to this page. As previously described, behavioral content server 160 may be configured to provide data identifying user behavior to page delivery component 110. For example, behavioral content server 160 may be a server or computing device that stores and provides user behavior data. Behavioral data can include, without limitation, categories of the pages previously visited by a user during a specific period of time.

To publish a web page, page assembler 310 may electronically communicate with user database 170, content database 180, and page template database 190 over one or more communication channels. Although FIG. 3 depicts page assembler 310 as being directly connected to user database 170, content database 180, and page template database 190, other connection schemes are possible, as will be apparent to those skilled in the art, to facilitate communication between page assembler 310 and one or more of the exemplary databases 170, 180, and 190. Such connection schemes include, for example, indirect, shared, and/or networked connections, as well as any of the other communication channels disclosed herein.

Page assembler 310 may also electronically communicate with user 320 over one or more communication channels. In accordance with some embodiments, a communication channel may include, in addition to the communication schemes previously described, including arrangements that use a public or private network. For example, a public network may be provided that includes any publicly-accessible network or networks interconnected via one or more communication protocols, including, but not limited to, hypertext transfer protocol (HTTP) and transmission control protocol/internet protocol (TCP/IP). The communication channels of FIG. 3 may also include one or more mobile device networks, wireless local area network (WLAN), and wireless metropolitan area network (WiMAX), that allow mobile devices (such as user 320 and/or other devices) to send and receive data via applicable communications protocols.

In accordance with some embodiments, user 320 may include a client-side device including, without limitation, a general purpose computing device, such as a personal computer, laptop computer, notebook computer, netbook, tablet, workstation, PDA, terminal, or like device. User 320 may also include a mobile device, such as a portable media device, traditional mobile phone, smart phone, navigation device, or other mobile computing device.

In accordance with some embodiments, slot engine 330 may be implemented using any suitable combination of hardware components and software configured to manage the exchange of data between page assembler 310 and module server(s) 120*a*-120*c*. For example, in some embodiments, slot engine 330 may be a component included in or coupled to communicate with a server-side device. In operation, page assembler 310 may be configured to call slot engine 330 to facilitate a bid session. In other embodiments, slot engine 330 may be called from a client-side device during a page request or delivery, for example.

In operation, slot engine 330 may be configured to provide a request for a bid to one or more module server(s) 120*a*-120*c*. The bids may be communications indicating how much a module provider is willing to pay for placement of one or more modules to be placed on a page assembled by page assembler 310, and what impact the one or more modules may have on a particular performance metric. In accordance with some embodiments, a bid may include content categories, user data, and/or performance metrics determined by the site owners. In other embodiments, slot engine 330 may provide additional information to module server 120 before, during, or concurrently with the request for a bid. Additional information may include, without limitation, a preferred set of content categories, historical performance of a user, and/or historical performance of a page. Historical performance of a page may include min/max/mean click-through rate CTR on content, min/max/mean CTR on ads, RPM, and/or other metrics known to those skilled in the art.

Slot engine 330 may also be configured to send business objectives to one or more module server(s) 120*a*-120*c*. For example, slot engine 330 may send data, for a particular bid, indicating what specific metric(s) a site owner values more than other metrics. Further, slot engine 330 may be configured to send requests for bids to one, all, or a specific combination of module servers 120*a*-120*c*.

Embodiments consistent with FIG. 3 and the present disclosure are not limited to a fixed number of module servers. Module servers 120*a*-120*c* are exemplary module servers, and are not intended to be comprehensive or limiting. In addition, in accordance with some embodiments, slot engine 330 may be coupled to communicate bids to others, such as shopping system 340, in a manner similar to communicating bids to module servers 120*a*-120*c*, as described above.

Figure 4:
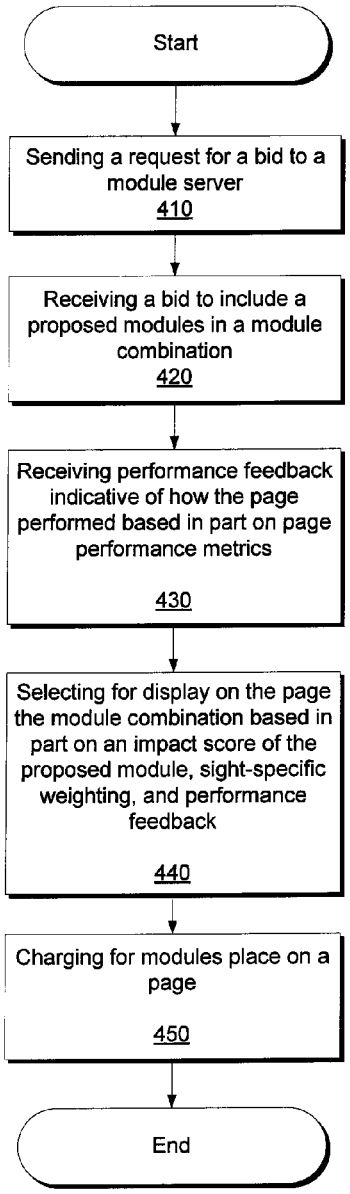
FIG. 4 illustrates a flow diagram of another exemplary method for web page optimization, consistent with the disclosed embodiments.

FIG. 4 illustrates a flow diagram of another exemplary method 300 for web page optimization, consistent with additional embodiments of the present disclosure. In the example of FIG. 4, the method is described with respect to common or similar module services. It will be appreciated, however, that the exemplary method can be adapted for any type of electronic content or combination of module services, including videos, audio files, images, articles, blogs, and/or other content accessible over the Internet.

By way of example, exemplary method 400 may enable a web site owner to send requests to a module provider to bid on module slots on a web page. Because the request includes information indicating how the site will evaluate and value a proposed module, a module provider's bid can provide the web site owner with an indication of how a proposed module will impact the site owner's business objectives for each page, as well as the categories of content the module provider can service. Although the steps disclosed in method 400 refer to a single module server and/or provider and a single bid, embodiments based on method 400 may be implemented with a plurality of module servers and/or providers submitting a plurality of bids.

As shown in FIG. 4, in step 410, a request for a bid is sent to a module server. In accordance with some embodiments, the request for a bid may include user data, content categories, page performance metrics, and/or business objective data. For example, slot engine 330 may send a business objective along with a particular bid request, indicating that for this bid request the web site owner values a particular metric more than other metrics. In accordance with some embodiments, a bid request may be initiated or called on the server-side. For example, page assembler 310 may be configured to call slot engine 330 to facilitate a bid session. In other embodiments, slot engine 330 may be called from the client-side, such as by user 320, during page delivery or rendering. For example, client-side code may be embedded in a browser or included in a separate file accessible by a user through a computing device and configured to call page assembler 310 to initiate a bid. Client-side code may include, without limitation, JavaScript source code, VBScript source code, or code programmed in any other scripting language suitable to exchange data with a server and/or respond to user input without communication from the server.

In accordance with some embodiments, a bid request may be provided to each module server. In other embodiments, a bid request may be provided to select module servers in response to a query of feedback server 130. For example, page delivery component 110 may query feedback server 130 for a list of modules having proposed impact values that met or exceeded their actual performance with respect to page performance metrics. Page delivery component 110 may also query feedback server 130 for modules that previously indicated being able to provide particular content categories.

In step 420, in response to sending a request for bid, one or more bids are received to include a proposed module or modules in a module combination to be displayed on a page. For example, module server 120 sends a bid to page delivery component 110 indicating a list of modules, content categories, and an impact score. The impact score may represent the impact or affect that each module will have on each of the respective performance metrics, as disclosed herein.

In accordance with some embodiments, module server 120 may also provide a price or other monetary value or criteria associated with a proposed module. For example, in response to a bid request, module server 120 may notify the page assembler 310, through or using slot engine 330, that the module should have a 5% impact on CTR, provide content in a food category, and cost $3.00 to put on a page. In some embodiments, module server 120 may represent an impact score as a numerical value within a range of values according to the relative impact a proposed module is predicted to have on a particular metric. For example, module server 120 may assign impact scores to a module labeled "customers also bought" as follows: Revenue=1; User engagement=2; Network recirculation=5. In this example, an impact score may range from 1 to of 5, 1 being the lowest impact and 5 being the highest impact. That is, by ranking the metric network recirculation a 5, module server 120 communicates to slot engine 330 that the proposed module has a larger impact on network recirculation than metrics revenue or user engagement. Though the following example represents the respective impact scores as unitless values, the impact scores may also have units. Further, other number types or range of values may be used to represent an impact.

To improve the likelihood that a particular bid will be accepted by page assembler 310, module server 120 may adjust the weighting or process used to calculate impact score based on historical performance data provided by feedback server 130. Historical performance data may include metrics on how the page performs with a proposed module, and how the page performs in aggregate so that scoring algorithms may be appropriately adjusted. For example, using historical performance data module server 120 may adjust the weighting applied to the module labeled "customers also bought" as follows: Revenue=1*(RHP); User Engagement=2*(UEHP); Network Recirculation=5*(NRHP). Respective historical performance weighting factors revenue historical performance (RHP), user engagement historical performance (UEHP), and network recirculation historical performance (NRNP) may be scale factors value suitable to represent the relative performance of a particular metric and recognized as such by page delivery component 110.

In accordance with some embodiments, module server may further adjust the impact score based in part on information gathered using, for example, a beacon or cookie generated by the module server. In operation, module server 120 receives information about the site's objectives to deliver better results. If, for example, a particular module is more interested in user-engagement today, that module can provide that hint to module server 120 so that module server 120 can choose to answer with modules that it thinks better contribute to user-engagement, as opposed to module server 120 selecting higher-RPM revenue alternatives. In some cases, past performance information may be used to stop module servers from exploiting or otherwise taking unfair advantage of the bidding system. For example, even if module server 120 responds indicating that the module it returns is a '5' in a certain category, historical performance data may be used to better normalize it's response with other 3rd party module servers. For example, a deal-site might think it's a '5', but compared to other module servers it's '5' appears to be closer to a '3' from other module-servers.

In some embodiments, a site owner may provide one or more cookies to module server 120 to enable the site owner to map user-data with the site owner's internal user-data. For example, a user on an auction site might have recently bid on some electronics that another site has no knowledge of. By mapping the user-data with site owner's own user-data, the module server associated with the auction site can provide customized electronics content, or possibly show current auctions the user is participating in, instead of some generic content. Thus, making the user more valuable to the module server associated with the auction site, and letting site owner of the auction site submit a higher bid than it would have if it had less knowledge about the user.

When a bid is accepted, module server 120 may receive a notification that the proposed bid is accepted and an indication of what impact the proposed module had on the page. For example, page delivery component 110 may notify module server 120 that its proposed bid was accepted and clicked on "x" number of times. In other cases, the impact may be represented as variation in how long a user spent on a page when a particular module or combination of modules was located on a page, or if a user clicked on ad/link-out and the average click-through rate of the page.

When a bid is accepted, each module server may receive a notification that the proposed bid is accepted and an indication of what impact the proposed module had on the page. For example, page assembler 310 may notify, using slot engine 330, one or more of aggregation publication system 120*a*, broker agent 120*b*, and third party content server 120*c* that their proposed bid was accepted and that their proposed module was clicked on "x" number of times. In other cases, the impact may be represented as variation in how long a user spent on a page when a particular module or combination of modules was located on a page, or if a user clicked on ad/link-out and the average click-through rate of the page.

In step 430, performance feedback indicative of how the page performed based may be gathered and provided by a feedback component. For example, feedback server 130 may collect data indicating the performance of a page in view of the page performance metrics established by the site owner. In some embodiments, performance feedback may indicate how a particular page performed with a proposed module or combination of proposed modules in accordance with the page performance metrics. Performance feedback may also include how a particular page performed in aggregate, regardless of whether or not a particular proposed module was present on the page. Additionally, or alternatively, performance feedback provided by feedback server 130 may include, for example, the number clicks received by a module, variation in how long a user spends on a page when a particular module or combination of modules is located on a page, and data indicating if a user clicked on ad/link-out and the average click-through rate of the page.

In accordance with some embodiments, feedback server 130 may act as an equalizer by providing feedback performance to page assembler 310, which provides an indication of the impact value anticipated by each module server 120 for a proposed module or combination of modules. In addition, feedback server 130 periodically may update each module server 120 at regular intervals, in response to a request from module server 120, or at any other interval or basis.

Once received, in step 440, page assembler 310 processes and ranks bids to select a module combination for display in a manner that maximizes the business objectives of the site owner with respect to a particular page. For example, page assembler 310 may apply web site or page specific weightings, either specified manually by the site owner or calculated by page assembler 310 based on what is required to achieve a business objective or target in view of the established page performance metrics. In some embodiments, to rank bids, page assembler 310 may call feedback server 130 to get historical information related to the historical performance of each proposed module on a particular site. Additionally, in accordance with some embodiments, historical performance may be used to rank modules according to the following:

Rank=(revenue impact score*site-specific weighting*historical performance)+(user engagement impact score*site-specific weighting*historical performance)+(network recirculation impact score*site-specific weighting*historical performance).

As previously described, in some embodiments, variables Rank, site-specific weightings, and historical performance may be unitless values. Variable site-specific weightings may represent a scale factor the relative importance page delivery component 110 may assign to a particular module. As such, site specific weighting may be, without limitation, a unitless numerical value, a function, or an algorithm. Furthermore, an impact score may be a unitless numerical value within a range of values representing the relative impact of a particular module with respect to a particular metric. In other embodiments, the impact scores may also have units. Further, other number types or range of values may be used to represent an impact score. Historical performance data, as previously described, may include metrics on how the page performs with a proposed module, and how the page performs in aggregate so that scoring algorithms may be appropriately adjusted. For example, using historical performance data module server 120 may adjust the weighting applied to the module labeled "customers also bought" as follows: Revenue=1*(RHP); User Engagement=2*(UEHP); Network Recirculation=5*(NRHP). Respective historical performance weighting factors revenue historical performance (RHP), user engagement historical performance (UEHP), and network recirculation historical performance (NRNP) may be scale factors value suitable to represent the relative performance of a particular metric and recognized as such by page delivery component 110. An exemplary rank calculation for the module "customer also bought" where page delivery component 110 seeks to maximize revenue may be calculated by page delivery component 110 by applying a site specific weighting factor of 5, 1, and 1, respectively for metrics revenue, user engagement, and network recirculation, respective impact scores of revenue, user engagement, and network recirculation are 1, 2, and 5, and the respective historical performance weighting factors are 5, 7, and 2, are as follows: Rank=(1*5*5)+(2*7*1)+(5*2*1)=49.

In cases where multiple modules return bids, slot engine 330 identifies those modules. Page assembler 310 may then apply a multiplier to the ranking algorithm due to the multiplicative effect resulting from placing both modules on a page. For example, if aggregation publication system 120*a* and broker agent 120*b* submit bids indicating they can serve finance-related modules, having both modules on a page will likely have a greater effect compared to having just one of them. In such case, the above exemplary ranking algorithm may be modified as follows: $\text{Rank}=(1*5*5)*CM_{revenue}+(2*7*1)CM_{user\ engagement}+(5*2*1)CM_{network\ recirculation}$. Multipliers $CM_{revenue}$, $CM_{user\ engagement}$, and $CM_{network\ recirculation}$ may be a unitless numerical value, such as an integer. In other embodiments, multipliers may be a function or algorithm suitable to reflect the increased weight given to duplicative modules proposed to be place on a web page. Once ranked, page assembler 310 may select the top "x" number of modules and returns the selected modules to the content management system that called them.

In step 450, a site owner charges module owners for placement of their respective modules on a page. For example, charging component 150 may charge a module owner providing module server 120 based on how a proposed module performs on a page in view of the page as a whole in view of the predetermined performance metrics. Charging may occur at the time of the auction or bid submission, by assigning each performance metric a particular value. In accordance with other embodiments, charging may be implemented consistent with the terms of a contract or predetermined billing procedure. For example, a module provider may contract with the site owner based on a proposed number of click-throughs on a site, the demographic/behavioral targeting segment of those clicks, or other suitable metrics.

Figure 5:
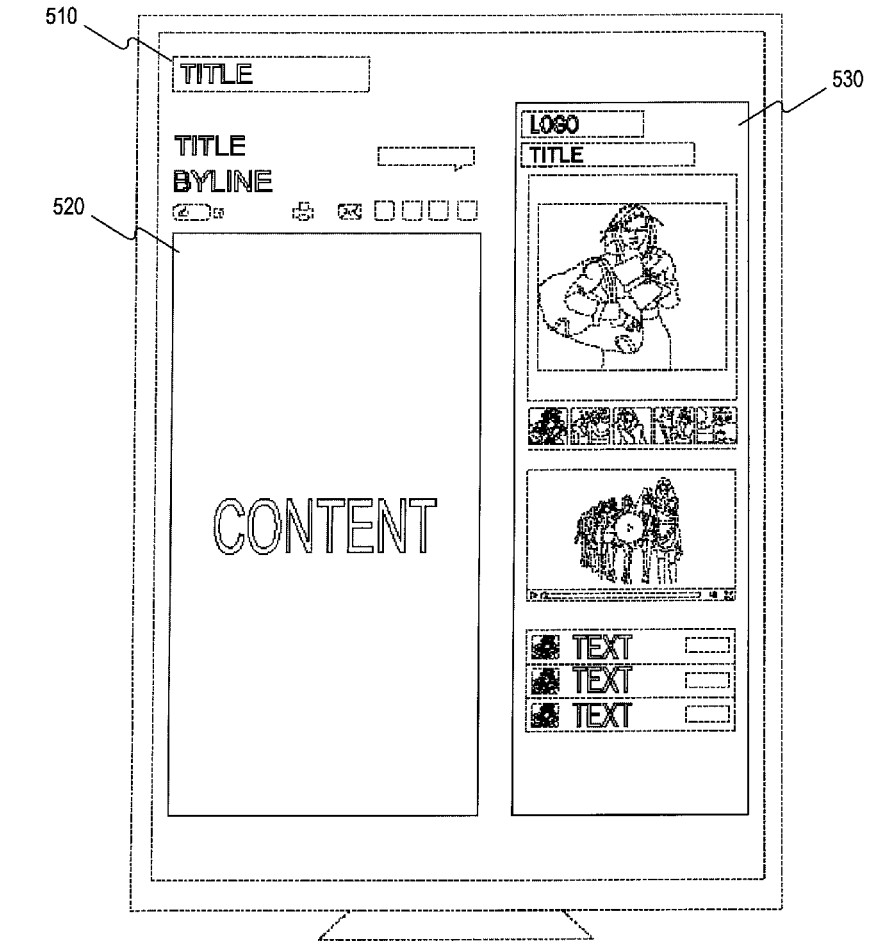
FIG. 5 illustrates a diagram of an exemplary web page, consistent with the disclosed embodiments.

FIG. 5 illustrates a diagram of an exemplary web page 500, consistent with disclosed embodiments. The embodiment of FIG. 5 provides an illustration of how modules or components may be organized on a web page. As will be appreciated from this disclosure, systems and methods for web page optimization may be implemented for web pages similar to web page 500, as well as other web pages with any number of modules and/or other arrangements.

By way of example, and as illustrated in FIG. 5, exemplary web page 500 may include navigation bar 510, main content 520, and module 530. The relative locations of navigation bar 510, main content 520, and module 530 are not intended to be limiting. That is, the relative locations of navigation bar 510, main content 520, and module 530 can be located in any suitable position on a webpage to implement the features of the embodiments described herein. As shown in FIG. 5, navigation bar 510 may include text, such as "TITLE," or a combination of text, still image, video, animation, graphics, or audio information. Text may be further formatted as a hypertext link providing navigation to other web pages or web sites. Main content 520 may be any combination text, still image, video, animation, graphics, or audio information that may be related to a theme and/or focus of a particular web page. Module 530 may comprise one or more unique components of a web page. Although not illustrated in FIG. 5, additional modules may also be provided for the web page. Furthermore, in accordance with certain embodiments, components are distinct from the main content of a web page. By way of example, components may include an advertisement, a list of most popular articles, a list of related photos and videos, and links to third party sites. Other examples of components will be apparent to persons of ordinary skill in the art in view of this disclosure.

Various embodiments have been described herein with reference to the accompanying drawings. It will, however, be evident that various modifications and changes may be made thereto, and additional embodiments may be implemented, without departing from the scope of the disclosure as set forth in the claims that follow. For example, embodiments of the present disclosure may be implemented as a method or process, an apparatus or system, or computer software on a computer medium. Furthermore, advantageous results still could be achieved if steps of the disclosed embodiments or techniques were performed in a different order and/or if components in the disclosed systems were combined in a different manner and/or replaced or supplemented by other components. Other implementations and embodiments will also be apparent to those skilled in the art from consideration of the specification and practice of one or more the embodiments disclosed herein.

It is intended, therefore, that this disclosure and the embodiments herein be considered as exemplary only, with a true scope and spirit of the disclosure being indicated by the following listing of exemplary claims.

What is claimed is:

1. A system for web page optimization, the system comprising:

a computing device comprising at least one processor configured to:

provide, to a module server, page performance metrics for a web site, the page performance metrics including a metric related to a length of time spent by a user on a page of the web site; and receive, from the module server, a bid to include at least one proposed module on the page of the web site, the bid including an impact score indicating an impact of the at least one proposed module based on the page performance metrics, the impact score based on a web cookie configured to map user Internet activity to user web site activity;

a feedback component coupled to the computing device and the module server, and configured to provide performance feedback indicative of how the page performed based in part on the page performance metrics; and a page assembler coupled to the feedback component and the computing device, and configured to select for display on the page a combination of modules including the at least one proposed module, wherein the combination of modules is selected based in part on the impact score and the performance feedback.

2. The system of claim 1, wherein the computing device is further configured to provide, to the module server, user data that includes at least one of demographic, behavioral, geographic, and temporal data.

3. The system of claim 1, wherein the page assembler selects the combination of modules based on a weighting for the page.

4. The system of claim 1, wherein the computing device is further configured to provide, to the module server, content categories including at least one category of content.

5. The system of claim 1, wherein the page performance metrics include metrics related to at least one of revenue, user engagement, and network recirculation.

6. The system of claim 1, wherein the page performance metrics provide a basis for evaluating the bid to include the at least one proposed module in the combination of modules.

7. The system of claim 1, wherein the impact score includes a value reflective of how the at least one proposed module affects a predetermined page performance metric.

8. The system of claim 1, wherein the module server includes at least one of an aggregation system or an ad network.

9. The system of claim 1, further comprising a charging component configured to assign a value to at least one of the page performance metrics.

10. A computer-implemented method for web page optimization, the method comprising:

sending, to a module server, page performance metrics for a web site, the page performance metrics including a metric related to a length of time spent by a user on a page of the web site;

receiving, from the module server, a bid to include at least one proposed module for display on the page of the web site, the bid including an impact score indicating an impact of the at least one proposed module based on the page performance metrics, the impact score based on a web cookie configured to map user Internet activity to user web site activity;

receiving performance feedback indicative of how the page performed based in part on the page performance metrics; and selecting for display on the page, by at least one processor, a combination of modules including the at least one proposed module, wherein the combination of modules is selected based in part on the impact score and the performance feedback.

11. The method of claim 10, further comprising sending, to the module server, user data that includes at least one of demographic, behavioral, geographic, and temporal data.

12. The method of claim 10, wherein the page performance metrics include metrics related to at least one of revenue, user engagement, and network recirculation.

13. The method of claim 12, wherein the revenue includes at least one of direct revenue and indirect revenue generated from a user action applied to the at least one proposed module when displayed to the user.

14. The method of claim 10, further comprising evaluating the bid to include the at least one proposed module in the combination of modules based in part on the page performance metrics.

15. The method of claim 10, further comprising evaluating the bid to include the at least one proposed module in the combination of modules based in part on the page performance metrics evaluated over a predetermined period of time.

16. The method of claim 10, further comprising evaluating the bid to include the at least one proposed module in the combination of modules based in part on a weighting value assigned to one of the page performance metrics.

17. The method of claim 10, wherein the proposed module comprises at least one of an advertisement, a list of most popular articles, a list of related content, and a link to another web page.

18. The method of claim 10, wherein the impact score is further based in part on information gathered using at least one of a beacon, and the web cookie is generated by the module server.

19. The method of claim 10, further comprising notifying the module server when the bid was accepted.

20. The method of claim 10, further comprising notifying the module server when the bid is accepted and providing to the module server an indication of an impact of the proposed module on the page.

21. The method of claim 20, wherein the indication of the impact of the at least one proposed module is based in part on at least one of a number of clicks on the at least one proposed module, a percentage increase in time the user spends on the page when the at least one proposed module is present, and click through rate.

22. The method of claim 10, further comprising sending to the module server performance feedback indicative of how the page performed with the at least one proposed module in accordance with the page performance metrics.

23. The method of claim 10, further comprising sending to the module server performance feedback indicative of how the page performed in aggregate in accordance with the page performance metrics.

24. The method of claim 10, further comprising sending to the module server performance feedback indicative of how the page performed in aggregate or with the at least one proposed module as a basis for adjusting the impact score.

25. The method of claim 10, further comprising assigning a value to one of the page performance metrics at auction time.

26. A computer-implemented method for web page optimization, the method comprising:

sending, from a computing device to a plurality of module servers, page performance metrics for a web site, the page performance metrics including a metric related to a length of time spent by a user on a page of the web site;

receiving, from the plurality of module servers, a plurality of bids to include at least one of a plurality of proposed modules in a combination of modules for display on the page of the web site, the plurality of bids including a plurality of impact scores associated with the plurality of proposed modules, the plurality of impact scores based on at least one web cookie configured to map user Internet activity to user web site activity;

receiving, from a feedback component, performance feedback indicative of how the page performed based in part on the page performance metrics; and selecting for display on the page, by the computing device, the combination of modules based in part on the plurality of impact scores and the performance feedback.

27. The method of claim 26, wherein the plurality of module servers is determined based on a query result returned from the feedback component.

28. The method of claim 26, further comprising:

receiving, from the plurality of module servers, a plurality of content categories;

identifying common content categories from the received plurality of content categories; and assigning a multiplier value to the page in response to identifying common content categories.

29. The method of claim 26, wherein the performance feedback indicates how a combination of the plurality of proposed modules performs on the page relative to the page performance metrics.

30. The method of claim 26, wherein the content categories include a list of preferred categories.

31. The method of claim 26, further comprising providing performance feedback indicative of how the page performed with at least one of the plurality of proposed modules in accordance with the page performance metrics.

32. The method of claim 26, wherein the performance feedback includes at least one of minimum click-through rate on content, maximum click-through rate on content, mean click-through rate on content, click-through rate on ads, and revenue per thousand page impression.

33. The method of claim 26, wherein the page performance metrics include relative weighting information of the page performance metrics indicating a business objective of the page.

34. The method of claim 26, further comprising receiving from the plurality of module servers a monetary value associated with a prospective impact on the page.

35. A non-transitory computer-readable medium comprising instructions that, when executed by a processor, cause the processor to perform a method comprising:

sending to a module server page performance metrics for a web site, the page performance metrics including a metric related to a length of time spent by a user on a page of the web site;

receiving, from the module server, a bid to include at least one proposed module in a combination of modules for display on the page of the web site, the bid including an impact score indicating an impact of the proposed module based on the page performance metrics, the impact score based on a web cookie configured to map user Internet activity to user web site activity;

receiving performance feedback indicative of how the page performed based in part on the page performance metrics; and selecting for display on the page the combination of modules based in part on the impact score of the proposed module and the performance feedback.

36. A non-transitory computer-readable medium comprising instructions that, when executed by a processor, cause the processor to perform a method comprising:

sending, from a computing device to a plurality of module servers, page performance metrics for a web site, the page performance metrics including a metric related to a length of time spent by a user on a page of the web site;

receiving, from the plurality of module servers, a plurality of bids to include at least one of a plurality of proposed modules in a combination of modules for display on the page of the web site, the plurality of bids including a plurality of impact scores associated with the plurality of proposed modules, the plurality of impact scores based on at least one web cookie configured to map user Internet activity to user web site activity;

receiving performance feedback indicative of how the page performed based in part on the page performance metrics; and selecting for display on the page the combination of modules based in part on the plurality of impact scores and the performance feedback.

37. The method of claim 26, wherein the computing device includes a user device configured to receive the page or a server side device included within a content management server.

* * * * *